US010941546B2

(12) United States Patent
Griechen et al.

(10) Patent No.: US 10,941,546 B2
(45) Date of Patent: Mar. 9, 2021

(54) MECHANICAL ELECTRICAL PLUMBING TUNNEL

(71) Applicant: Katerra Inc., Menlo Park, CA (US)

(72) Inventors: Darrin Griechen, Spokane, WA (US); Robert Stanford, Flowery Branch, GA (US)

(73) Assignee: Katerra Inc., Menlo Park, CA (US)

( * ) Notice: Subject to any disclaimer, the term of this patent is extended or adjusted under 35 U.S.C. 154(b) by 0 days.

(21) Appl. No.: 16/682,184

(22) Filed: Nov. 13, 2019

(65) Prior Publication Data

US 2020/0149251 A1 May 14, 2020

Related U.S. Application Data

(60) Provisional application No. 62/760,411, filed on Nov. 13, 2018.

(51) Int. Cl.
*E03C 1/02* (2006.01)
*E02D 29/00* (2006.01)
*E04C 2/52* (2006.01)

(52) U.S. Cl.
CPC ..... *E03C 1/021* (2013.01); *E02D 29/10* (2013.01); *E04C 2/521* (2013.01)

(58) Field of Classification Search
CPC ..... E03C 1/021; E02D 29/10; E94C 2/521
USPC ..... 52/79.1
See application file for complete search history.

(56) References Cited

U.S. PATENT DOCUMENTS 5,953,871 A * 9/1999 MacConnell ..... E04B 2/7451 52/220.1
5,964,067 A * 10/1999 Lehner ..... E04C 1/40 52/220.2
6,101,773 A * 8/2000 Chau ..... H02G 3/288 174/500
7,669,371 B2 * 3/2010 Hill ..... E04F 15/024 52/220.1
8,028,487 B2 * 10/2011 Engstrom ..... E04B 2/767 52/645
8,800,221 B1 * 8/2014 Header ..... E04B 2/88 52/204.5
2005/0034408 A1 * 2/2005 Palumbo ..... E04B 2/7457 52/633
2008/0178542 A1 * 7/2008 Williams ..... H02G 3/0493 52/220.7

* cited by examiner

*Primary Examiner* — Jeanette E Chapman
(74) *Attorney, Agent, or Firm* — Volpe Koenig

(57) ABSTRACT

A Mechanical Electrical Plumbing (MEP) tunnel is provided. The MEP tunnel includes a rear side, a first side, and a second side. The MEP tunnel is configured to be disposed in a wall frame. The MEP tunnel may also include a plurality of tubing used for mechanical, electrical, and plumbing utilities. The MEP tunnel is connected to the wall frame via two mechanical devices. The MEP tunnel can move up and down between a raised position and a lowered position in the wall frame via two tracks in the MEP tunnel and the two mechanical devices. The MEP tunnel remains in the raised position during shipping and lowered at the completion of installation.

10 Claims, 11 Drawing Sheets

MECHANICAL ELECTRICAL PLUMBING TUNNEL

CROSS REFERENCE TO RELATED APPLICATION

This application claims the benefit of U.S. Provisional Application No. 62/760,411 for MECHANICAL ELECTRICAL PLUMBING TUNNEL filed on Nov. 13, 2018, which is incorporated by reference as if fully set forth.

FIELD OF INVENTION

The present invention relates generally to the art of building construction, and more specifically to the installation of mechanical, electrical, and plumbing systems for buildings.

BACKGROUND

Utility connections such as mechanical, electrical, and plumbing (MEP) tubes and hookups are typically installed on site piece by piece. Installing these components is tedious and time consuming, which ultimately results in higher construction costs.

SUMMARY

In one aspect, a Mechanical Electrical Plumbing (MEP) tunnel is provided that can be prefabricated and installed in a wall frame prior to being shipped to a job site.

The MEP tunnel includes a rear side, a first side, and a second side. The MEP tunnel is configured to be disposed in a wall frame. The MEP tunnel may also include a plurality of tubing and wires for MEP connections. The MEP tunnel may also include at least two tracks.

A wall frame with at least one MEP tunnel is also provided. The wall frame includes a first mechanical device and a second mechanical device. The first side of the MEP tunnel is connected to the first mechanical device via the first track and the second side of the MEP tunnel is connected to the second mechanical device via the second track. The tracks allow the MEP to move up and down between a raised position and a lowered position.

BRIEF DESCRIPTION OF THE DRAWINGS

The foregoing summary, as well as the following detailed description will be better understood when read in conjunction with the appended drawings. For the purpose of illustration, there is shown in the drawings different embodiments. It should be understood, however, that the teachings are not limited to the precise MEP tunnel and wall panel arrangement shown.

DETAILED DESCRIPTION

A mechanical, electrical, and plumbing (MEP) tunnel is provided. The MEP tunnel includes a rear side, a first side, and a second side. The MEP tunnel is configured to be disposed in a wall frame. The MEP tunnel may also include a plurality of tubing and wires for MEP connections. The MEP tunnel may also include at least two tracks. The MEP tunnel provides a mechanism to hold MEP connections such as electrical wires, conduit, plumbing tubes, etc. The MEP connections may be attached to the MEP tunnel in a factory or any appropriate onsite location. The MEP tunnel can be easily installed on site with MEP connections set up and ready to be installed. Moreover, the MEP tunnel may be installed in a prefabricated wall panel. The wall panel may be shipped with the MEP tunnel connected. On site, the wall panel may be installed and the MEP tunnel easily maneuvered to quickly and efficiently connect and install the mechanical, electrical, and plumbing utilities. Thus, an MEP system that can be pre-assembled in a factory and can be quickly and efficiently installed on the job site is provided saving time and money.

Figure 1A:
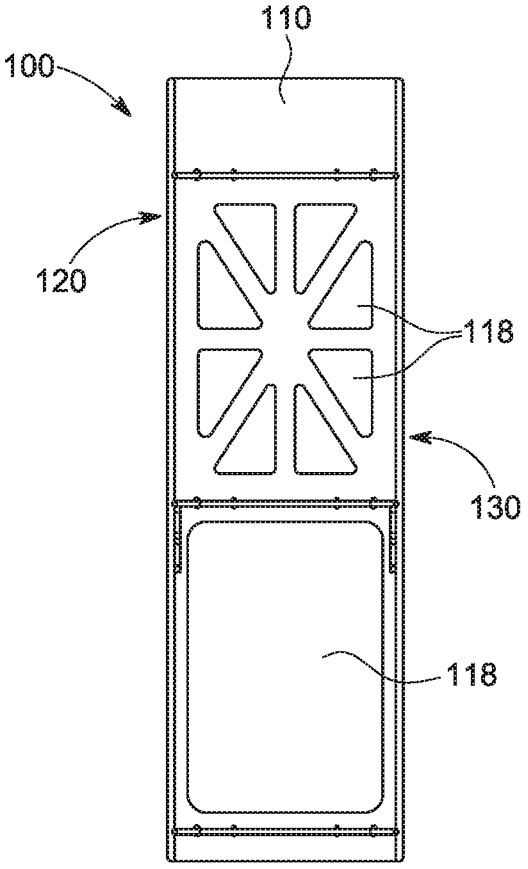
FIG. 1A is a front view of an MEP tunnel.

FIG. 1A is a front view of an MEP tunnel 100. As shown in FIG. 1A, a mechanical, electrical, and plumbing (MEP) tunnel 100 is provided. The MEP tunnel 100 includes a rear side 110, a first side 120, and a second side 130. The rear side 110, first side 120, and second side 130 form a channel. Additionally, the MEP tunnel 100 may also include a front side (not shown) for additional bracing or structural support. The MEP tunnel 100 may also include openings 118 in the rear side 110 to access the MEP connections. The openings 118 also allow for inspection and lighten the assembly.

Figure 1B:
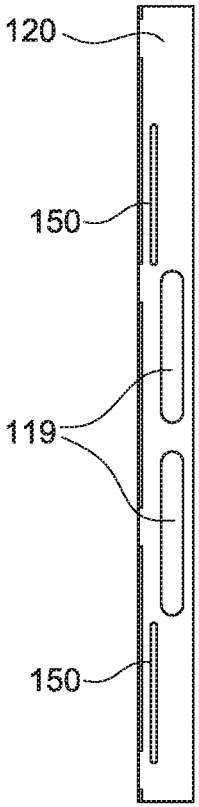
FIG. 1B is an elevation view of the MEP tunnel.

FIG. 1B is an elevation view of the MEP tunnel 100. FIG. 1B depicts the first side 120 of the MEP tunnel 100. Although the first side 120 is depicted, the second side 130 may be a mirror image of the first side 120. Each MEP tunnel 100 includes at least two open tracks 150; at least one track 150 in the first side 120 and at least one track in the second side 130. FIG. 1B depicts two tracks 150 on the first side 120, and therefore, there are two tracks on the second side 130. The tracks 150 are used to connect the MEP tunnel 100 to a wall frame. This connection is discussed in detail below.

The MEP tunnel 100 may also include openings 119 in the first side 120 and/or second side 130. These openings 119 allow access to the MEP connections. The openings 119 also allow for inspection and lighten the assembly.

Figure 1C:
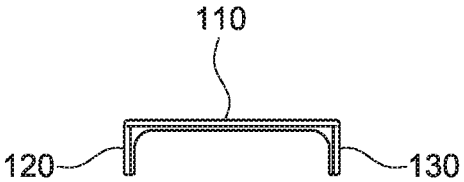
FIG. 1C is a top view of the MEP tunnel.

FIG. 1C is a top view of the MEP tunnel 100. The first side 120 and the second side 130 are connected to the rear side 110 at approximately 90 degree angles. The first side 120 and the second side 130 may be welded, bolted, screwed, or otherwise connected to the rear side 110. Alternatively the first side 120, second side 130, and rear side 110 may be one bent piece. The MEP tunnel 100 may be constructed from sheet metal, steel, aluminum, plastic, or any other structurally rigid material.

Figure 2A:
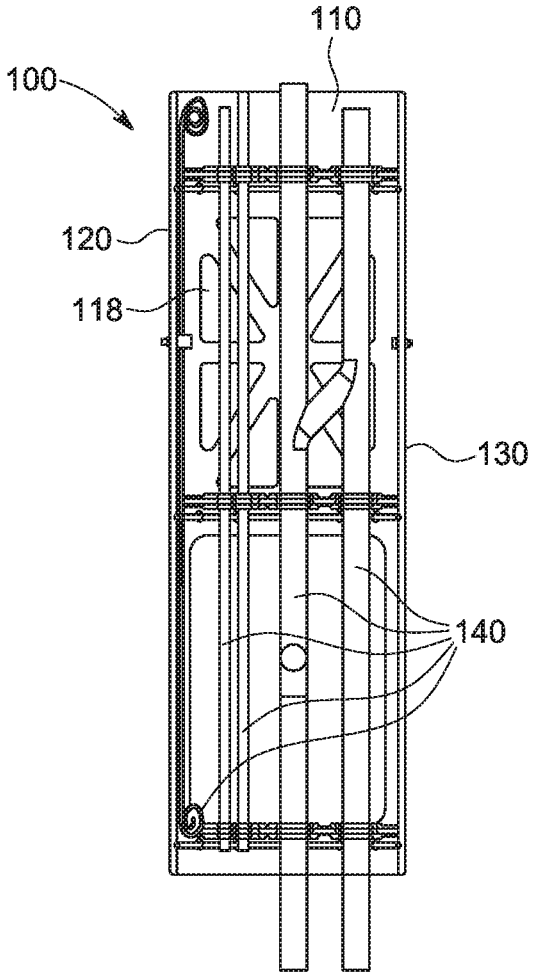
FIG. 2A is a front view of an MEP tunnel including a plurality of tubing and wires.
Figure 2B:
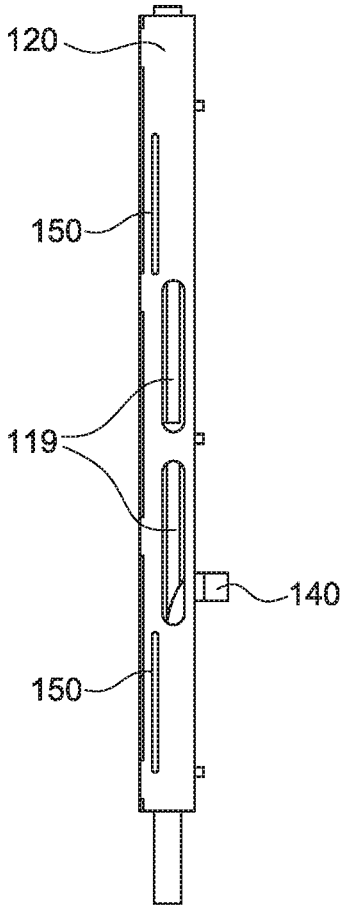
FIG. 2B is an elevation view of the MEP tunnel including a plurality of tubing and wires.

FIG. 2A is a front view of an MEP tunnel 100 including a plurality of tubing and wires 140. FIG. 2B is an elevation view of the MEP tunnel 100 including a plurality of tubing 140 for MEP connections and utilities. The plurality of tubing and wires 140 are secured to the MEP tunnel 100. The tubing and wires 140 may be used for MEP utilities. The tubing and wires 140 may be secured to the MEP tunnel 100 in the factory. When the MEP tunnel 100 is shipped to its final location, the MEP tunnel 100 may be installed and the utilities easily connected.

Figure 2C:
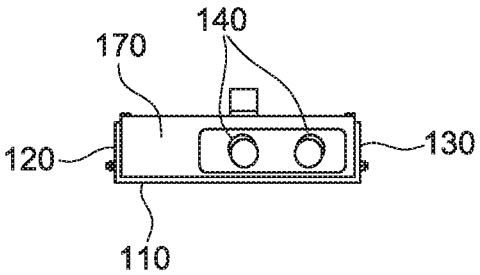
FIG. 2C is a bottom view of the MEP tunnel including a plurality of tubing and wires.

FIG. 2C is a bottom view of the MEP tunnel 100 including a plurality of tubing 140. As shown in FIG. 2C, the bottom of the MEP tunnel 100 may be closed off with a bottom plate 170. If the bottom of the MEP tunnel 100 is closed rather than open, the bottom plate 170 has openings to allow the tubing 140 to extend beyond the bottom of the MEP tunnel 100.

Figure 3:
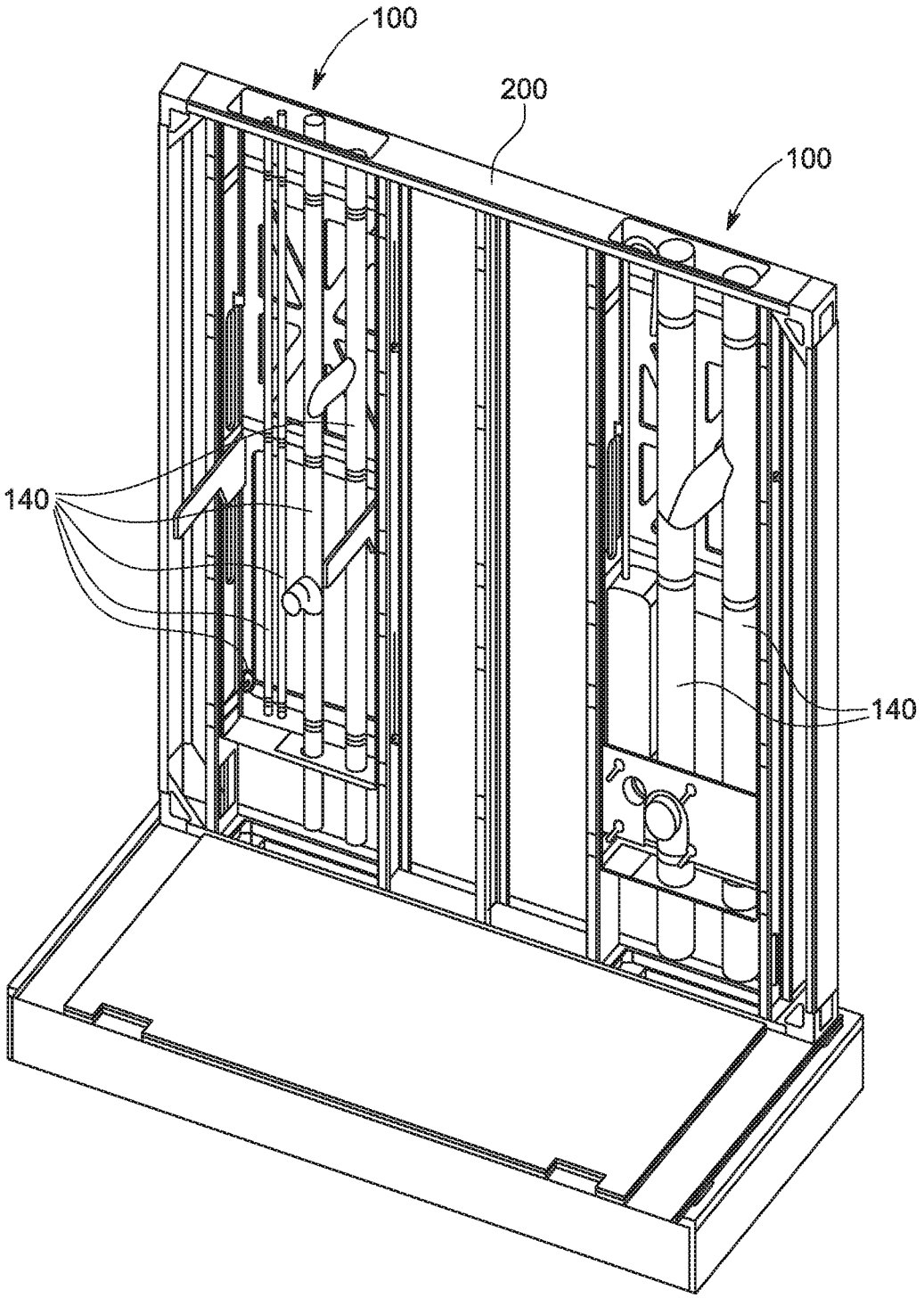
FIG. 3 is a front, right perspective view of a wall frame with two MEP tunnels in a raised position.

FIG. 3 is a front, right perspective view of a wall frame 200 with two MEP tunnels 100 in a raised position. The MEP tunnel 100 is configured to be disposed in a wall frame 200. The wall frame 200 may include a plurality of MEP tunnels 100. For example, FIG. 3 depicts a wall frame 200 with two MEP tunnels 100. However, the wall frame 200 may include more or less MEP tunnels. As shown in FIG. 3, the MEP tunnels 100 may have different types of MEP utilities. For example, a first MEP tunnel 100 may include washer and dryer hookups, while a second MEP tunnel 100 may include pipes for a shower and/or toilet hookup.

Figure 4A:
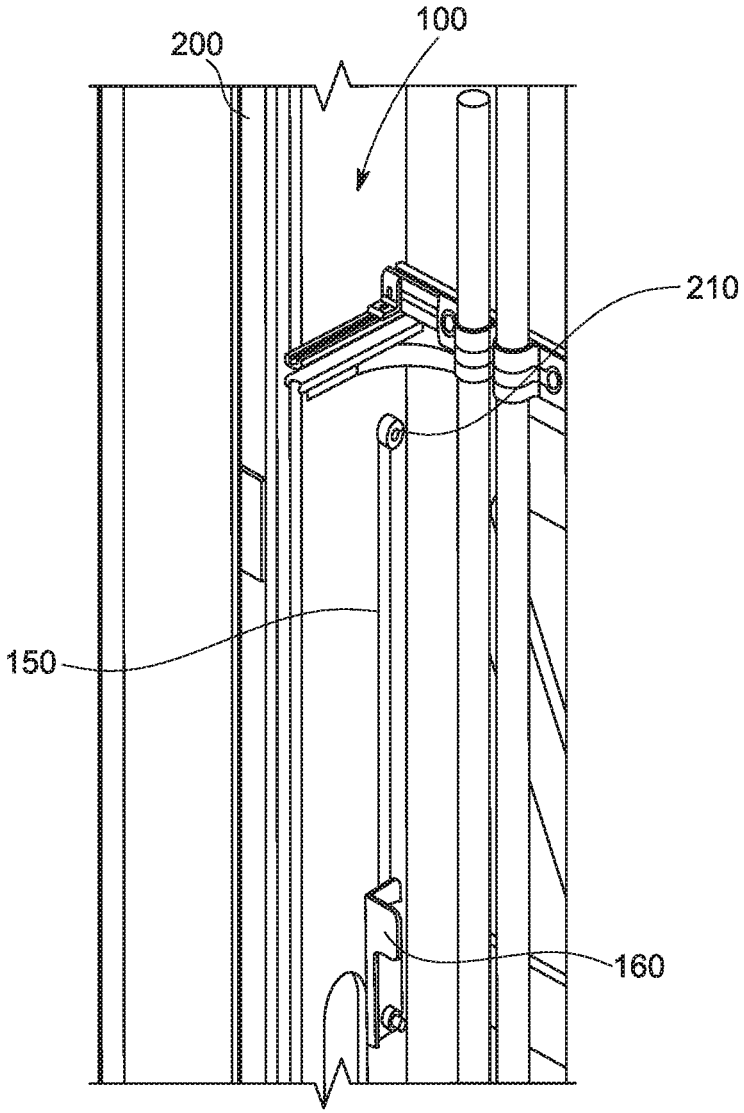
FIG. 4A is a section view of the wall frame and MEP tunnel showing a mechanical device, track, and latch when the MEP tunnel is in a lowered position.
Figure 5:
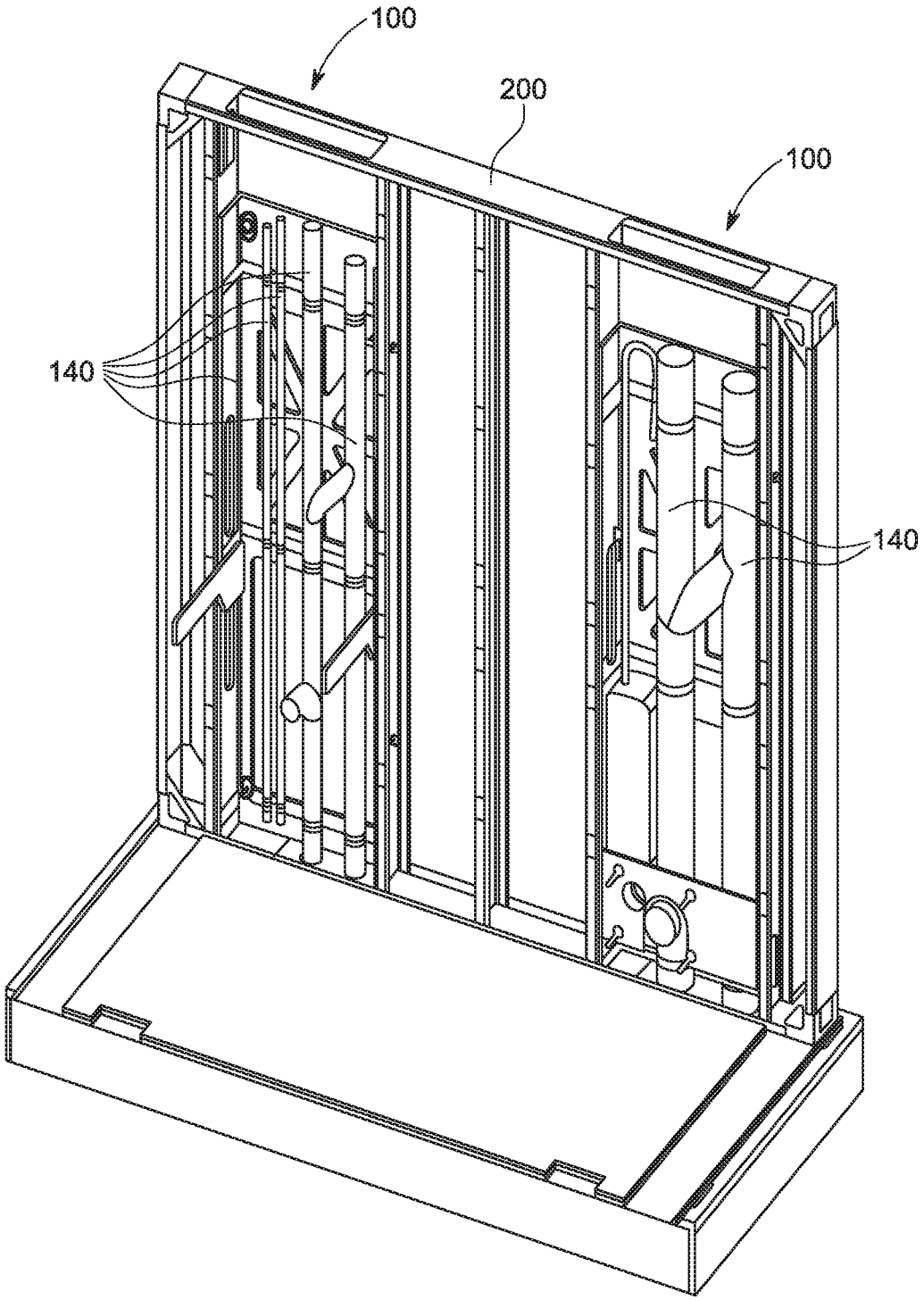
FIG. 5 is a front, right perspective view of the wall frame with two MEP tunnels in a lowered position.

FIG. 4A is a section view of the wall frame 200 and MEP tunnel 100 showing a mechanical device 210, track 150, and latch 160 when the MEP tunnel 100 is in a lowered position. FIG. 4A depicts a section of an MEP tunnel 100 to illustrate the mechanical device 210 and open track 150 connection. The wall frame 200 includes at least two mechanical devices 210. More specifically, the wall frame 200 may include a mechanical device 210 at each track 150 location. The section view in FIG. 4A shows one track 150 and therefore one mechanical device 210. The mechanical devices 210 connect each MEP tunnel 100 to the wall frame 200. The mechanical device 210 is connected to the wall frame 200. The mechanical device may include a prong or screw that extends through the track 150 and a head or bolt that attaches to the prong or screw. The head of the mechanical device 210 may have a diameter that is larger than the width of the track 150 so that the track 150 cannot slip past the head of the mechanical device 210. The mechanical device 210 and track 150 connection allows the MEP tunnel 100 to move up and down within the wall frame 200. The mechanical device 210 keeps the MEP tunnel 100 in position laterally while allowing the MEP tunnel 100 to move vertically within the limits of the track 150. The MEP tunnel 100 may move between a raised position, as shown previously in FIG. 3, and a lowered position, as shown in FIG. 5. FIG. 5 is a front, right perspective view of the wall frame 200 with two MEP tunnels 100 in a lowered position. Referring back to FIG. 4A, the section view shows the mechanical device 210 and track 150 connection when the MEP tunnel 100 is in the lowered position. In the lowered position, the mechanical device 150 is at the top of the track 150. At this point, the MEP tunnel 100 cannot slide any lower. Gravity keeps the MEP tunnel 100 at this position unless the MEP tunnel 100 is physically raised.

Figure 4B:
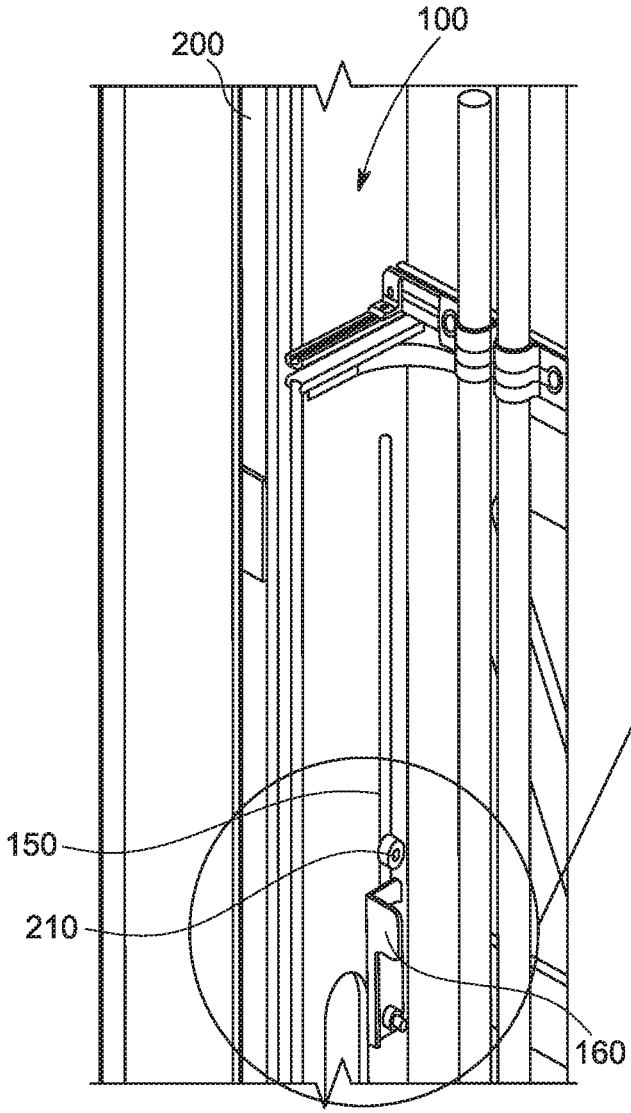
FIG. 4B is a section view of the wall frame and MEP tunnel showing the mechanical device, track and latch when the MEP tunnel is being raised.

FIG. 4B is a section view of the wall frame 200 and MEP tunnel 100 showing the mechanical device 210, track 150 and latch 160 when the MEP tunnel 100 is being raised. As the MEP tunnel 100 rises, the track 150 rises. As the track 150 rises, the mechanical device slides towards the bottom of the track 150.

Figure 4C:
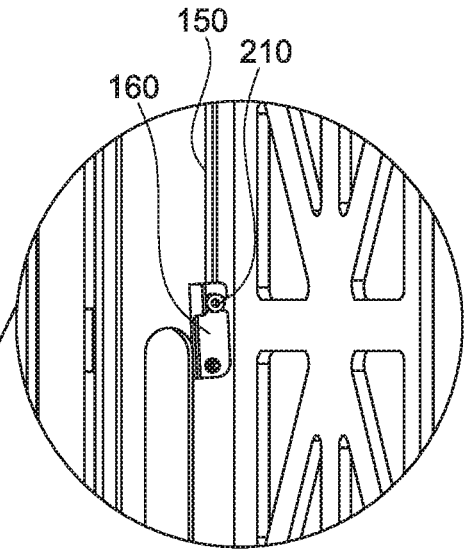
FIG. 4C is a front view of the latch and the mechanical device when the MEP tunnel is locked in the raised position.

FIG. 4C is a front view of the latch 160 and the mechanical device 210 when the MEP tunnel 100 is locked in the raised position. The MEP tunnel 100 may also include a latch 160. The latch 160 may be a plate with a notch configured to receive and hold a mechanical device 210. The latch 160 may be connected to the MEP tunnel 100 via a pivoting mechanism such as a loose fitted screw and bolt. The latch 160 may be rotated away from the track 150 so that the mechanical device 210 may reach the bottom of the track 150 without interference. The latch 160 may secure the MEP tunnel 100 in the raised position by engaging with the mechanical device 210, as shown in FIG. 4C. When the mechanical device 210 is at or near the bottom of the track 150, the latch 160 may be rotated toward the track 150 until the mechanical device 210 is received by the notch in the latch 160. When the latch 160 is engaged with the mechanical device 210, the MEP tunnel 100 is no longer free to move vertically. The MEP tunnel 100 is locked in place when the latch 160 is engaged. Generally, the MEP tunnel 100 is locked in a raised position until the wall frame 200 and MEP tunnel 100 are installed at the final location. The raised position prevents damage to the MEP tunnel 100 during shipping and handling by ensuring all MEP connections, the plurality of tubing and wires 140, attached to the MEP tunnel 100 do not extend beyond the wall frame 200 and are thereby protected by the MEP tunnel 100 and wall frame 200. The raised position also prevents damage by preventing the MEP tunnel 100 from moving during shipping and handling. Although not depicted, the MEP tunnel 100 may include a latch 160 at the top of the track 150. The latch 160 at the top of the track 150 may be a mirror image of the latch 160 at the bottom of the track 150. This latch 160 may be rotated down and towards the track so that the MEP tunnel 100 is prevented from being raised.

Figure 6:
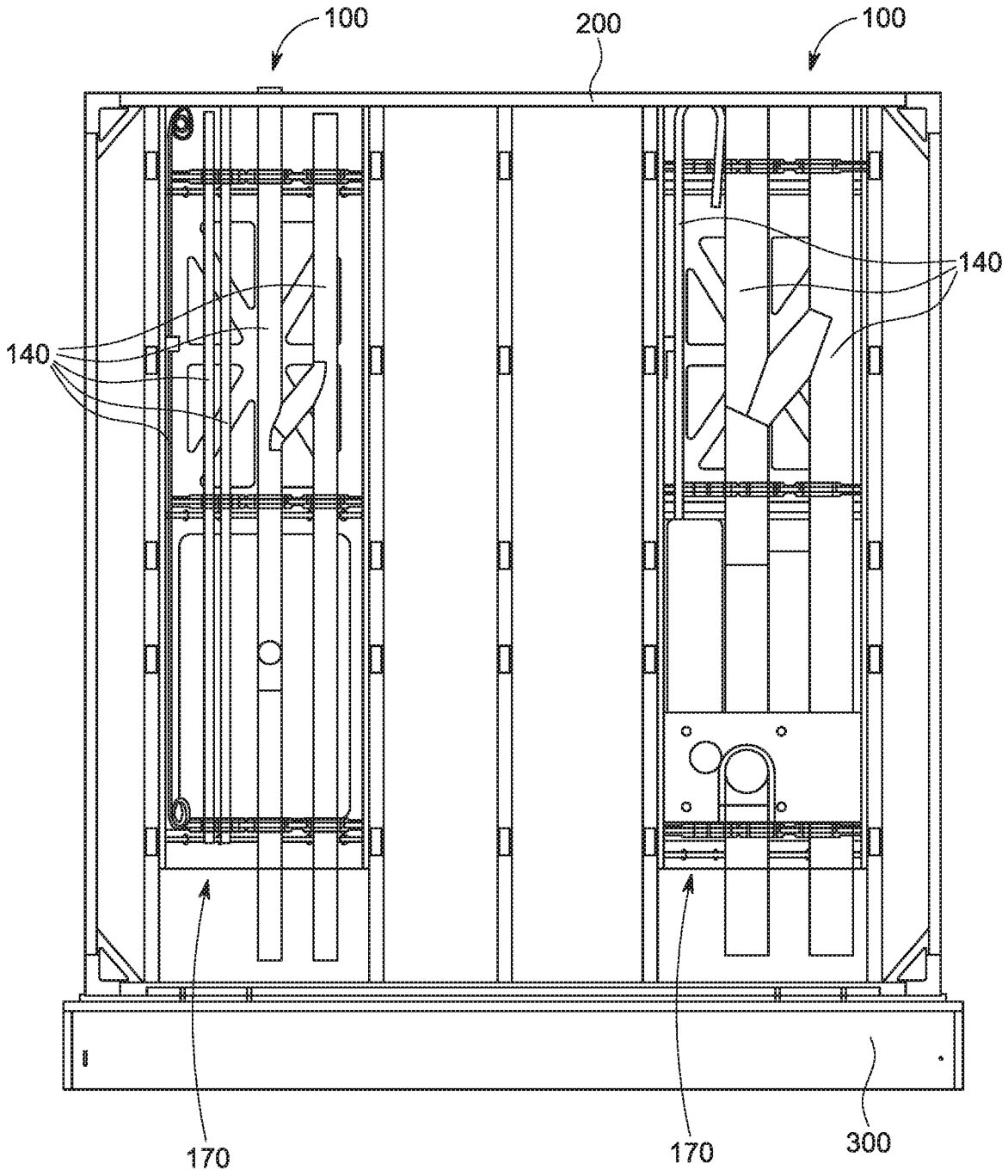
FIG. 6 is a front view of the wall frame with two MEP tunnels in a raised position.

FIG. 6 is a front view of the wall frame 200 with two MEP tunnels 100 in a raised position. The wall frame 200 and MEP tunnels 100 are installed at the final location. The MEP tunnels 100 are towards the top of the wall frame 200 in a raised position. The bottom plate 170 is raised above the bottom of the wall frame 200 and the floor 300. As shown in FIG. 6, the plurality of tubing and wire 140 are protected within the MEP tunnel 100 and the wall frame 200.

Figure 7:
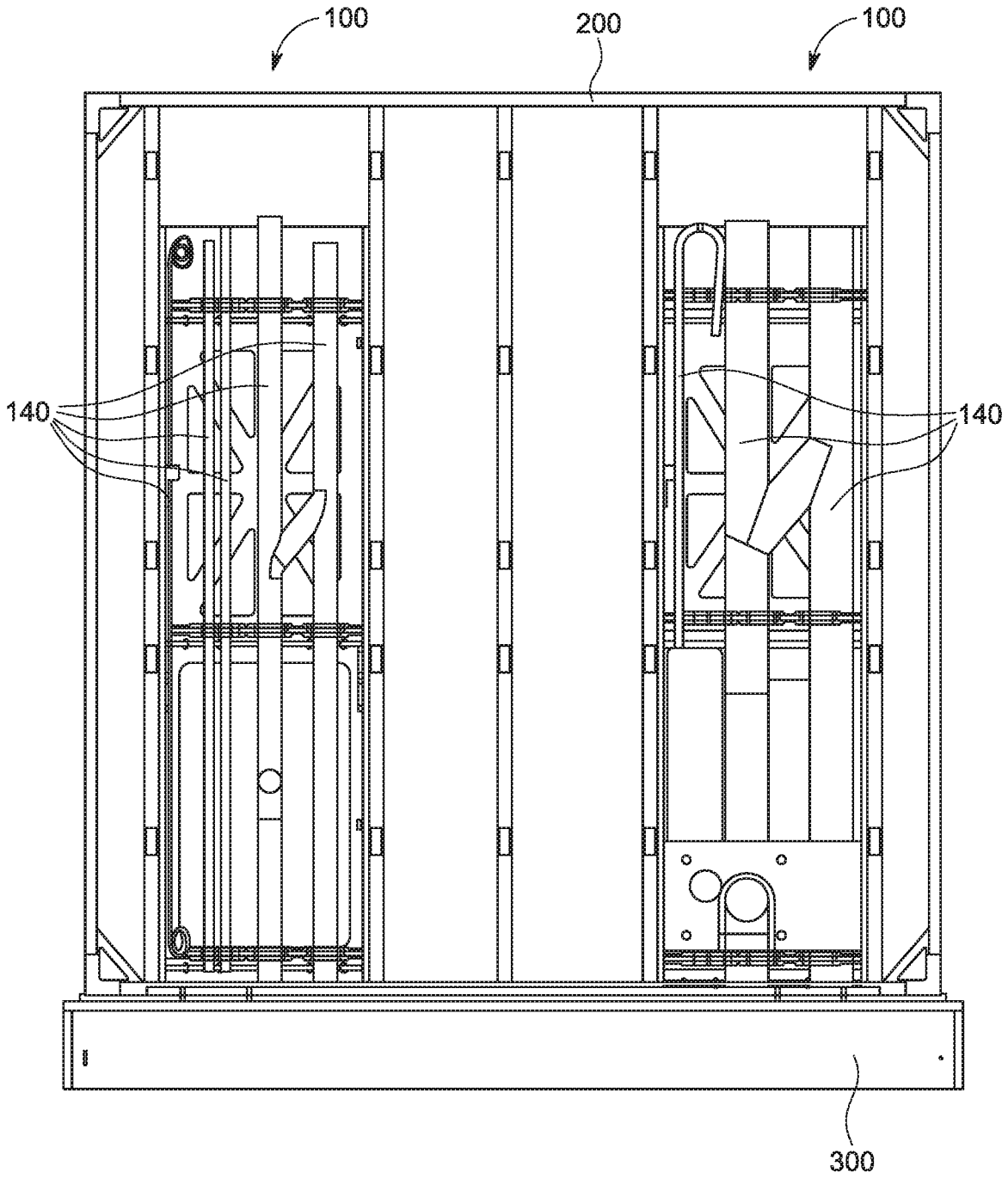
FIG. 7 is a front view of the wall frame with two MEP tunnels in a lowered position.

FIG. 7 is a front view of the wall frame 200 with two MEP tunnels 100 in a lowered position. The bottoms of the MEP tunnels 100 are adjacent with the floor 300. The plurality of tubing and wires 140 are in an installation position and may be connected to other tubing and wires from floors immediately above or below the wall frame 200 and floor 300, or the plurality of tubing and wires 140 may be connected to the utilities or appliances. In the installed position, the tubing and wires 140 may extend through the bottom of the wall frame 200 and the floor 300 to allow the tubing 140 to be connected with MEP tubing below the floor 300.

Figure 8:
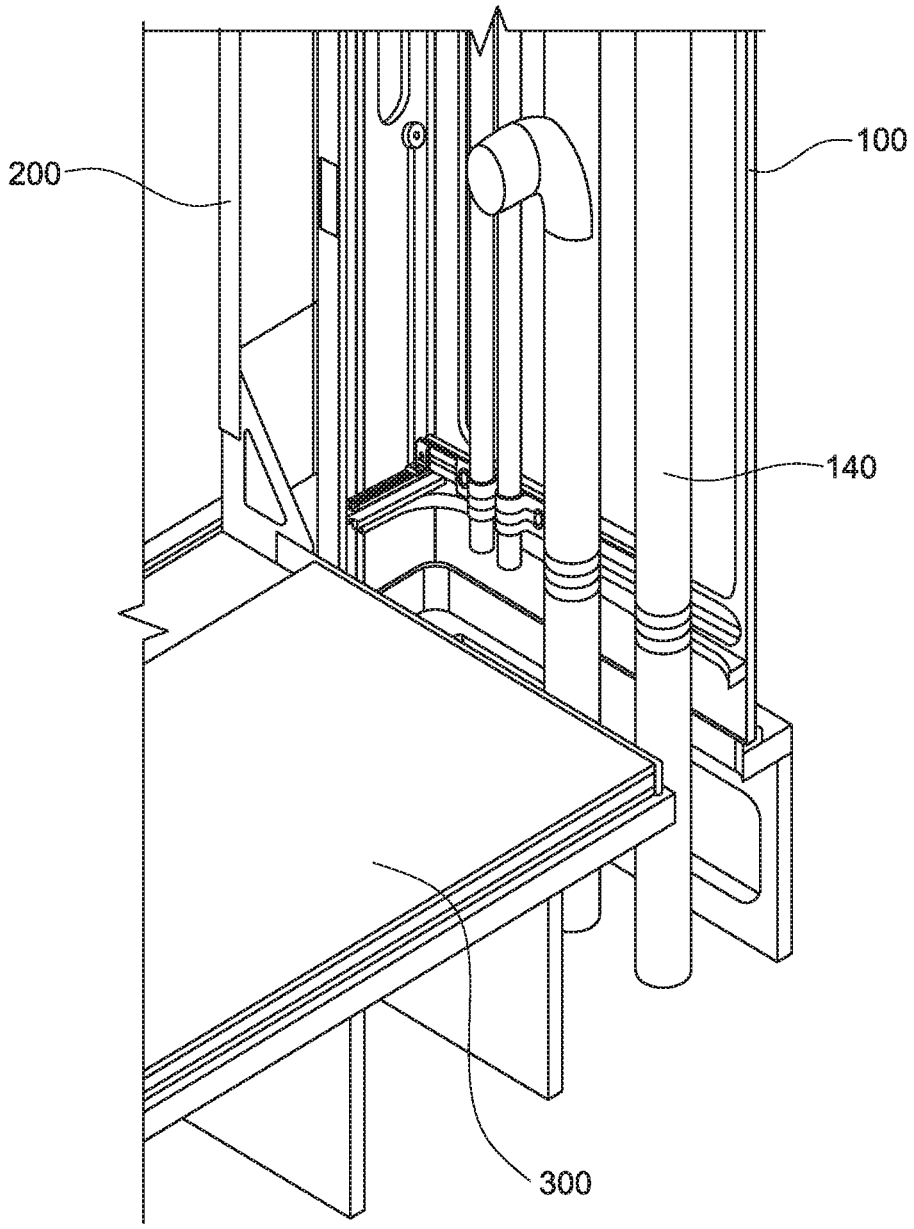
FIG. 8 is a front, right perspective view of a section of the MEP tunnel showing the bottom of the MEP tunnel and tubing in a lowered position with an open bottom.
Figure 9:
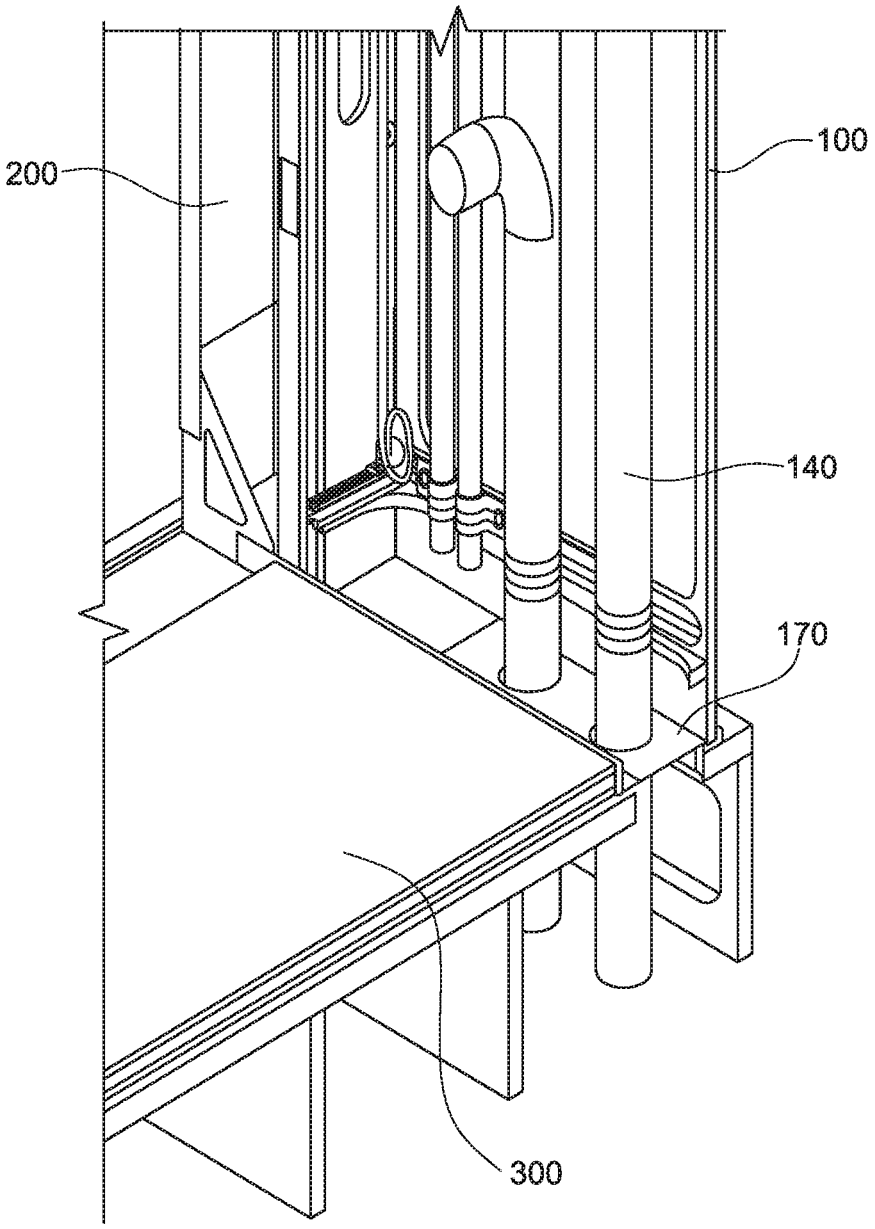
FIG. 9 is a front, right perspective view of a section of the MEP tunnel showing the bottom of the MEP tunnel and tubing in a lowered position with a bottom plate.

FIG. 8 is a front, right perspective view of a section of the MEP tunnel 100 showing the bottom of the MEP tunnel 100 and tubing 140 in a lowered position with an open bottom. FIG. 9 is a front, right perspective view of a section of the MEP tunnel 100 showing the bottom of the MEP tunnel 100 and tubing 140 in a lowered position with a bottom plate 170. The MEP tunnel 100 may also include a plate 170 attached to the bottom of the MEP tunnel 100, as opposed to an open bottom, as shown in FIG. 8. The plate 170 closes off the bottom of the MEP tunnel 100 and the wall frame 200 and acts as a fire block when the MEP tunnel 100 is in the lowered or installed position.

Figure 10:
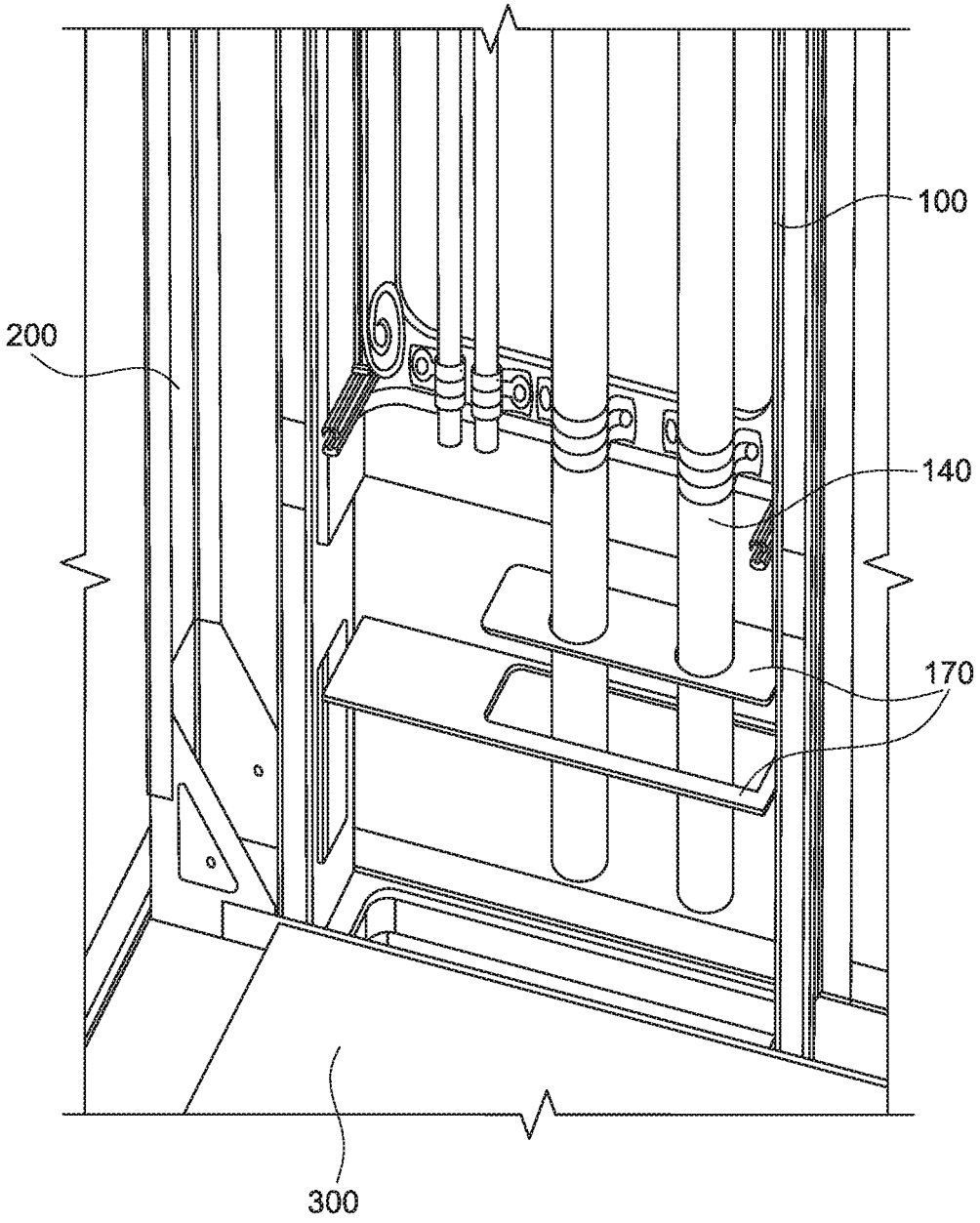
FIG. 10 is a front, right perspective view of a section of the MEP tunnel showing the bottom of the MEP tunnel and tubing in a raised position with an exploded view of the plate.

FIG. 10 is a front, right perspective view of a section of the MEP tunnel 100 showing the bottom of the MEP tunnel 100 and tubing 140 in a raised position with an exploded view of the plate. As shown in FIG. 10, the bottom plate 170 may include a smaller plate fitting into a larger plate or a smaller plate fitting onto a larger plate. The bottom plate 170 forms a fire-break between floors. A single plate could be used or a double plate, as shown in FIG. 10, to offer flexibility.

Having thus described in detail a preferred selection of embodiments of the present invention, it is to be appreciated and will be apparent to those skilled in the art that many physical changes could be made to the MEP tunnel 100 without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A Mechanical Electrical Plumbing (MEP) tunnel comprising:

a rear side;

a first side;

a second side, the second side and the first side connecting with the rear side;

at least one first open track located on the first side; and at least one second open track located on the second side, wherein the MEP tunnel is configured to be disposed in a wall frame.

2. The MEP tunnel of claim 1 further comprising a plurality of tubing.

3. The MEP tunnel of claim 2 wherein the plurality of tubing includes at least one of mechanical, electrical, and plumbing utilities.

4. The MEP tunnel of claim 1 further including a plate at a bottom of the MEP tunnel.

5. A wall comprising:

a frame;

a first mechanical device connected to the wall frame;

a second mechanical device connected to the wall frame; and an MEP tunnel including a rear side connected to a first side and a second side, at least one first open track located on the first side and at least one second open track located on the second side, the first side connected to the first mechanical device, and the second side connected to the second mechanical device, and a plurality of tubing connected to at least one of the first side, the second side, and the rear side.

6. The wall of claim 5 wherein the first mechanical device is connected to the first side via the at least one first open track and the second mechanical device is connected to the second side via the at least one second open track.

7. The wall of claim 5 wherein the MEP tunnel moves between a raised position and a lowered position.

8. The wall of claim 5 further comprising a plate at a bottom of the MEP tunnel.

9. The wall of claim 5 further comprising a third mechanical device connected to the frame and a fourth mechanical device connected to the frame.

10. The wall of claim 9 further comprising a second MEP tunnel including an other rear side connected to an other first side and an other second side, the other first side connected to the third mechanical device and the other second side connected to the fourth mechanical device.

* * * * *